US009528226B2

(12) United States Patent
Campbell

(10) Patent No.: US 9,528,226 B2
(45) Date of Patent: Dec. 27, 2016

(54) CURB DRAIN BLOCK

(71) Applicant: Walter Campbell, Fairfield, OH (US)
(72) Inventor: Walter Campbell, Fairfield, OH (US)

( * ) Notice: Subject to any disclaimer, the term of this patent is extended or adjusted under 35 U.S.C. 154(b) by 0 days.

(21) Appl. No.: 14/476,613

(22) Filed: Sep. 3, 2014

(65) Prior Publication Data

US 2016/0060818 A1 Mar. 3, 2016

(51) Int. Cl.
*E01C 11/22* (2006.01)

(52) U.S. Cl.
CPC ..... *E01C 11/223* (2013.01)

(58) Field of Classification Search
CPC ..... E01C 11/22; E01C 11/223
USPC ..... 404/4, 5; 405/40, 127
See application file for complete search history.

(56) References Cited

U.S. PATENT DOCUMENTS 6,227,758 B1 * 5/2001 Missick ..... E01C 11/223 210/164
6,234,711 B1 * 5/2001 Beaman ..... E01C 11/223 249/2
6,394,700 B1 * 5/2002 Fish ..... E01F 5/005 138/96 R
2011/0278211 A1 * 11/2011 Flood, Jr. ..... E01C 11/223 210/170.03

FOREIGN PATENT DOCUMENTS

GB 2217364 A * 10/1989 ..... E01C 11/223

* cited by examiner

*Primary Examiner* — Benjamin Fiorello
(74) *Attorney, Agent, or Firm* — Jenei LLC

(57) ABSTRACT

A rectangular channel is cut into a contoured concrete curb along a street to expose an end of ground drain pipe. Sealing fill material is applied to portions of cut surfaces of the rectangular channel. A curb drain modular insert that is placed into the rectangular channel has a molded body that is formed to have a rear surface, bottom surface and lateral surfaces that are generally planar. The lateral surfaces are generally parallel to each other. Each lateral surface, rear surface and bottom surface being generally perpendicular to each other for being placed into the rectangular channel cut into the contoured curb. The molded body has a contoured top surface that conforms to portions of the contoured curb that are adjacent to the rectangular channel. A horizontal bore is formed in the molded body from the rear surface through the top surface to conduct ground water.

5 Claims, 5 Drawing Sheets

CURB DRAIN BLOCK

BACKGROUND OF THE INVENTION

1. Field of the Invention

The field of art disclosed herein pertains to a modular curb assembly forming a drainage assembly within a road curb of concrete, asphalt or other material. More specifically the pre-cast components are made from polymers or other materials, which form a finished surface when cast and installed within the roadside curb or other structures.

2. Description of the Related Art

Curbs are constructed in a variety of manners for use with roads, pathways, landscaping, and structures. Typically, curbs are formed where a raised portion of land or material meets an unraised portion of land or material. However, some curbs can be constructed as raised sections between two unraised portions of land or material. Curbs may be formed to provide draining options, provide borders for roads or paths, provide decorative edges, provide support for portions of raised materials, or provide safety or directional means for pedestrians and a variety of transporting vehicles. Curbs generally are constructed of sturdy materials such as concrete, asphalt, stone, or similar materials. Concrete curbs are especially popular because of the flexibility in shaping them, their relatively reasonable cost, and durability.

Residential streets increasingly are provisioned with contoured concrete curbs that present a rounded, flared surface to cars and bicycles to present tire and wheel damage. A lower, flattened portion of the contoured concrete curbs serves as a path for rainwater to flow to a storm drain. Residential homes often direct rain water from a roof or from the surround yard through an underground drain pipe that terminates at an opening cut into the curb. Older rectangular curbs provided a perpendicular surface suitable for boring a cylindrical hole for the drain pipe. However, the contoured concrete curbs present a surface that is generally difficult to drill into. Consequently, generally known techniques include using a concrete saw blade to remove a rectangular channel in the curb. The drain pipe extends at least to the edge of the rectangular channel to dispense water. Often the drain pipe is subject to damage from car tires.

SUMMARY OF THE INVENTION

In one aspect, the present disclosure provides a curb drain modular insert that includes a molded body that is formed to have a rear surface, bottom surface and lateral surfaces that are generally planar. The lateral surfaces are generally parallel to each other. Each lateral surface and rear surface and bottom surface being generally perpendicular to each other for being placed into a rectangular channel cut into a contoured curb. The molded body is further formed to have a contoured top surface that conforms to portions of the contoured curb that are adjacent to the rectangular channel. A horizontal bore is formed in the molded body from the rear surface through the top surface to conduct ground water.

In another aspect, the present disclosure provides a method of making a curb drain modular insert. In one embodiment, the method includes molding a body that is formed to have a rear surface, bottom surface and lateral surfaces that are generally planar, the lateral surfaces being generally parallel to each other; each lateral surface and rear surface and bottom surface being generally perpendicular to each other for being placed into a rectangular channel cut into a contoured curb. The method includes molding a contoured top surface of the molded body that conforms to portions of the contoured curb that are adjacent to the rectangular channel. The method further includes forming a horizontal bore in the molded body from the rear surface through the top surface to conduct ground water.

In an additional aspect, the present disclosure provides a method of forming a drain path between a ground drain pipe and a street gutter. In one embodiment, the method includes cutting a rectangular channel in a contoured concrete curb along a street to expose an end of ground drain pipe. The method further includes applying a sealing fill material to portions of cut surfaces of the rectangular channel. The method includes inserting the curb drain modular insert into the rectangular channel.

These and other features are explained more fully in the embodiments illustrated below. It should be understood that in general the features of one embodiment also may be used in combination with features of another embodiment and that the embodiments are not intended to limit the scope of the invention.

BRIEF DESCRIPTION OF THE DRAWINGS

The various exemplary embodiments of the present invention, which will become more apparent as the description proceeds, are described in the following detailed description in conjunction with the accompanying drawings, in which.

DETAILED DESCRIPTION

The present innovation relates generally to a modular curb assembly forming a drainage assembly within a road curb of concrete, asphalt or other material. More specifically the pre-cast components are made from polymers or other materials, which form a finished surface when cast and installed within the roadside curb or other structures.

Figure 1:
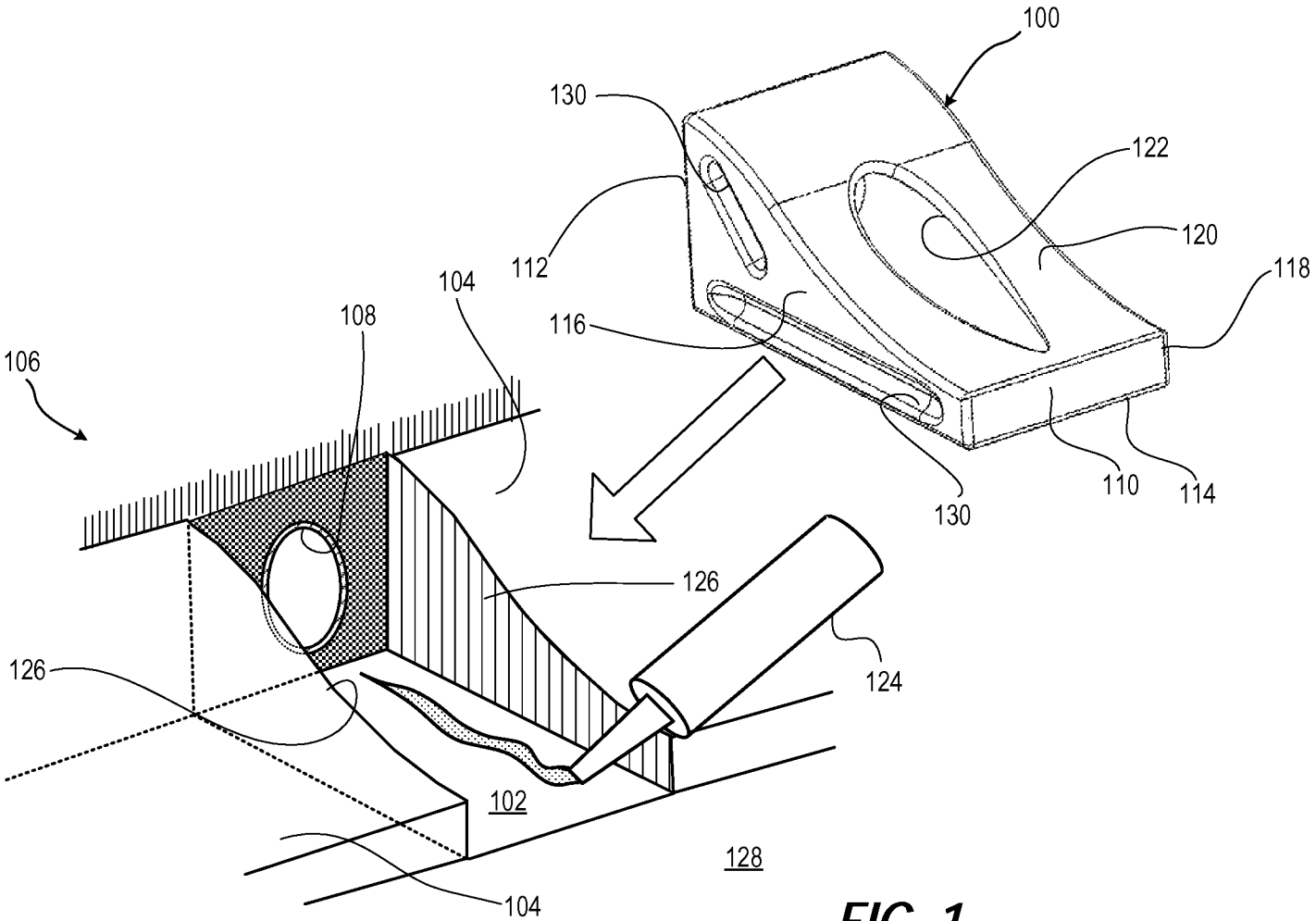
FIG. 1 illustrates a perspective view of a curb drain modular insert prior to installation in rectangular channel cut into a contoured curb, according to one or more embodiment.

FIG. 1 illustrates a curb drain modular insert 100 for being placed into a rectangular channel 102 cut into a contoured curb 104 along a street 106. The curb drain modular insert 100 conducts drain water from a ground drain pipe 108. The curb drain modular insert 100 has a molded body 110 that is formed to have a rear surface 112, a bottom surface 114 and left and right lateral surfaces 116, 118 that are generally planar. The lateral surfaces 116, 118 are generally parallel to each other, although the lateral surfaces 116, 118 can be flared outwardly at their top for a trapezoidal cut channel. Each lateral surface 116, 118, rear surface 112 and bottom surface 114 can be generally perpendicular to each other for being placed into the rectangular channel 102 cut into the contoured curb 104. The molded body 110 has a contoured top surface 120 that conforms to portions of the contoured curb 104 that are adjacent to the rectangular channel 102. A horizontal bore 122 is formed in the molded body from the rear surface through the top surface to conduct ground water. The horizontal bore 122 can have a slight downward angle from rear to front to drain water completely. FIG. 1 illustrates the horizontal bore 122 to have a circular transverse cross section.

In one embodiment, the molded body 110 is formed from polymer material. In other embodiments the molded body 110 is formed from ceramic material, sintered material, or malleable concrete material.

The purpose of the curb drain modular insert 100 is to replace the use of drainage pipes in the curb that are prone to break from excessive weight and inclement weather and cause deterioration of surrounding concrete. The existing drainage system using PVC pipe and concrete can be damaged as soon as it is exposed to heavy traffic and weather. The concrete poured over the PVC pipe is too thin to stand up to any kind of stress causing failure and cracking the PVC pipe. The curb drain modular insert of the present invention is installed with concrete on the sides and bottom and eliminates the need for the PVC pipe and the concrete on top that would be exposed to vehicular traffic.

The curb drain modular insert 100 can be installed new or in existing curbs and is attached to the yard drainage pipe. For replacement of damaged pipe, the pipe is removed and the curb drain modular insert 100 is secured to the existing cement with high strength adhesive. For new installation, the curb drain modular insert 100 is placed in wet concrete flush with curb and edged to finish. The curb drain modular insert 100 is notched on the sides for secure bonding to concrete. The curb drain modular insert 100 can be manufactured to curb style and dimensions up to a 4" pipe connection or larger.

In one embodiment, the molded body 110 is preferably formed from a polymeric material, such as polyethylene, polypropylene, nylon, glass filled thermoplastics or the like. In another embodiment, the molded body 110 is formed from a plastic material, preferably a thermoplastic selected from the group of polyolefins including low-density polyethylene (LDPE), high-density polyethylene (HDPE), polypropylene (PP) and mixtures thereof. In another embodiment, the molded body 110 is made of durable high-density polyethylene (HDPE). In general, the molded body 110 is made with materials that can withstand heavy traffic, exposure to chemicals such as gas and oil and exposure to hot and cold temperatures. In one embodiment, the curb drain modular insert 100 is textured on top to provide a non-skid surface.

In addition, it is contemplated to use re-rod or other metal rod (not shown) vertically disposed within the curb drain modular insert 100 to secure and hold down the curb elements if necessary. The re-rod may be threaded, as an example, enabling the curb elements to be downwardly secured by a threaded fastener, nut and washer or by any suitable means known in the art.

Sealing fill material 124 can be applied to cut surfaces 126 of the rectangular channel 102 to prevent water from damaging the rectangular channel 102 and road surface material 128. Recesses 130 formed in the lateral surface 116, 118, rear surface 112 or bottom surface 114 can receive a portion of the sealing fill material 124 to hold the curb drain modular insert 100 in place.

Figure 2:
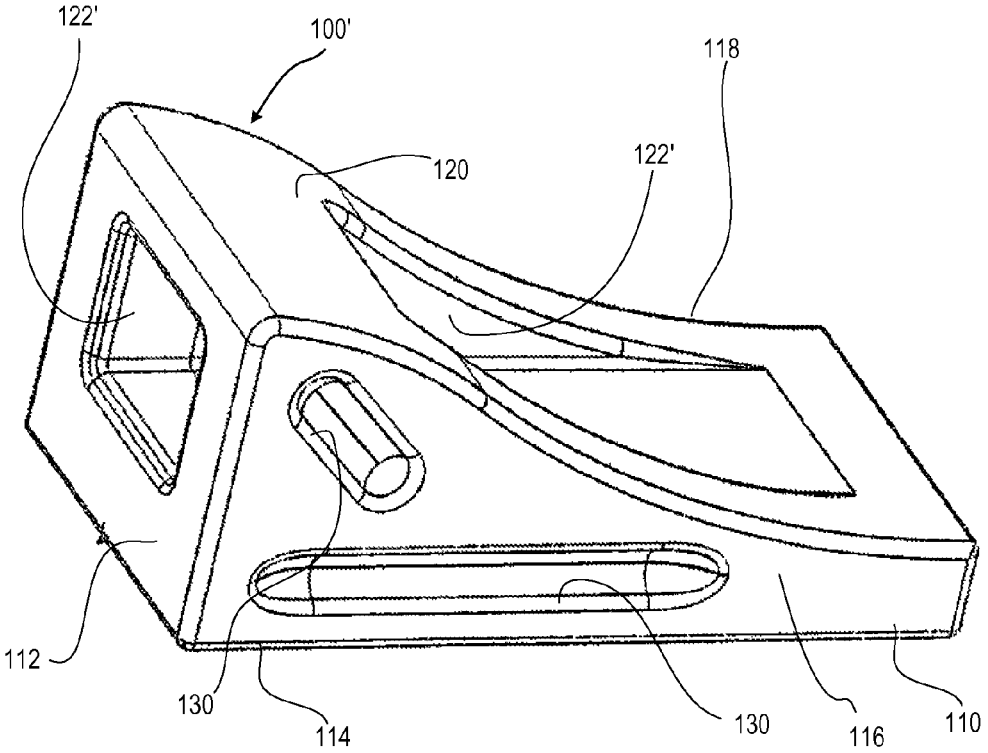
FIG. 2 illustrates a perspective view of an alternative curb drain modular insert that has a rectangular horizontal bore, according to one embodiment.
Figure 3:
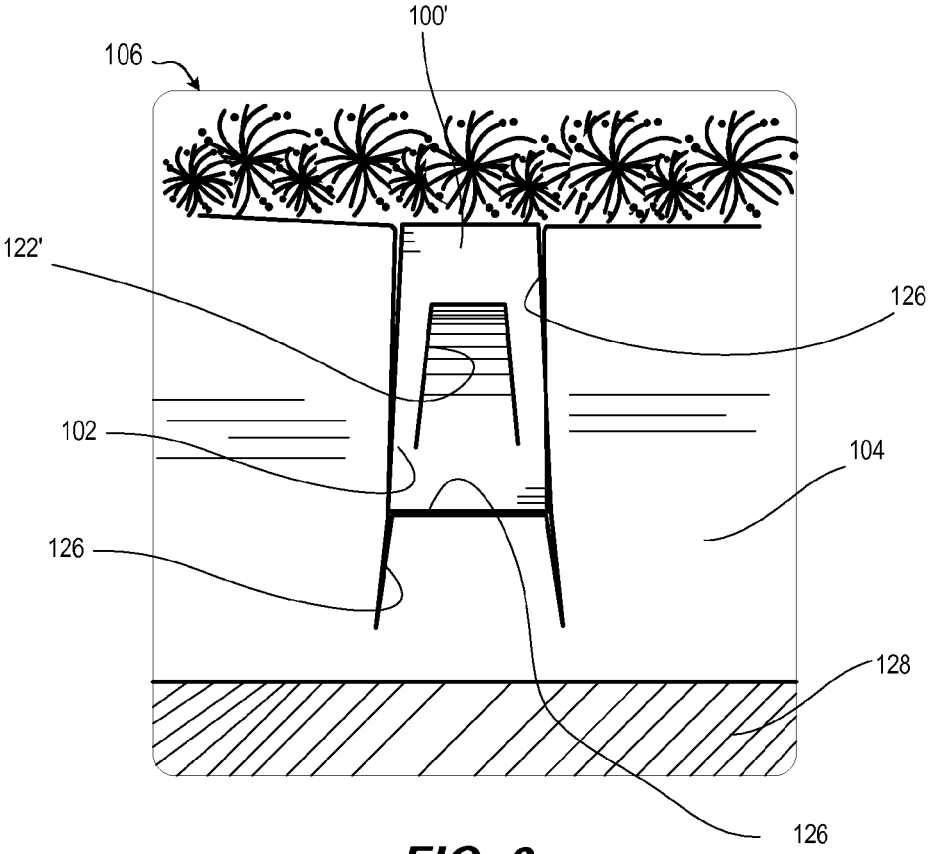
FIG. 3 illustrates a side view of the alternative curb drain modular insert of FIG. 2 installed into the rectangular channel of the contoured curb, according to one embodiment.

FIG. 2 illustrates a curb drain modular insert 100' that is identical the curb drain modular insert 100 (FIG. 1) except for having a horizontal bore 122' of a rectangular transverse cross section. FIG. 3 illustrates the curb drain modular insert 100' installed into a rectangular channel 102 cut into a contoured curb 104.

Figure 4:
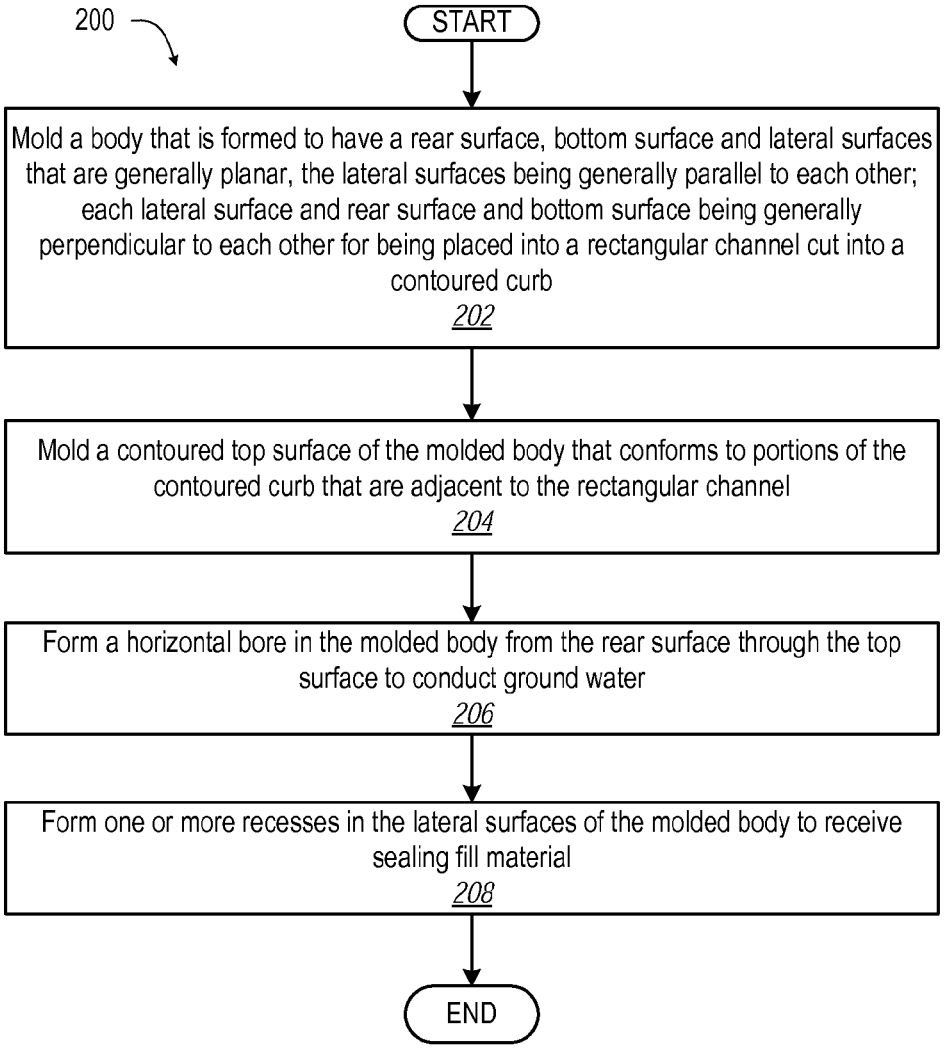
FIG. 4 illustrates a flow diagram of a method of making a curb drain modular insert, according to one embodiment.

FIG. 4 illustrates method 200 of making a curb drain modular insert. The method 200 includes molding a body that is formed to have a rear surface, bottom surface and lateral surfaces that are generally planar, the lateral surfaces being generally parallel to each other; each lateral surface and rear surface and bottom surface being generally perpendicular to each other for being placed into a rectangular channel cut into a contoured curb (block 202). The method 200 further includes molding a contoured top surface of the molded body that conforms to portions of the contoured curb that are adjacent to the rectangular channel (block 204). The method 200 further includes forming a horizontal bore in the molded body from the rear surface through the top surface to conduct ground water (block 206). In one embodiment, the method further includes forming a recess to receive sealing material in one or more of the lateral surfaces and bottom surface.

Figure 5:
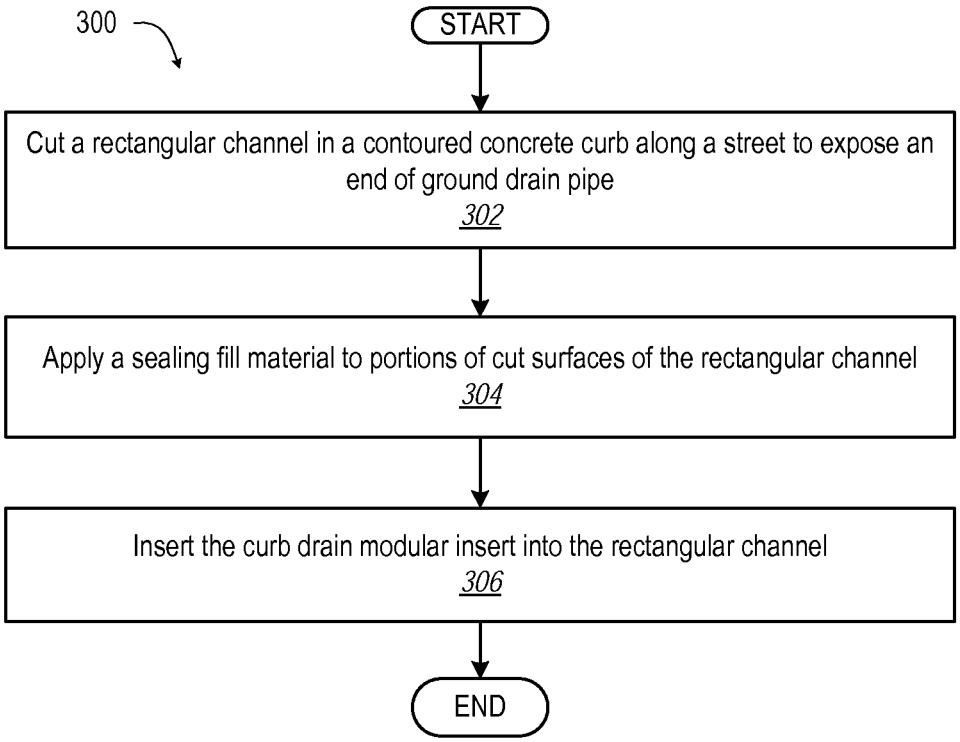
FIG. 5 illustrates a flow diagram of a method of forming a drain path between a ground drain pipe and a street gutter, according to one embodiment.

FIG. 5 illustrates a method 300 of forming a drain path between a ground drain pipe and a street gutter. In one embodiment, the method 300 includes cutting a rectangular channel in a contoured concrete curb along a street to expose an end of ground drain pipe (block 302). The method 300 includes applying a sealing fill material to portions of cut surfaces of the rectangular channel (304). The method 300 includes inserting the curb drain modular insert into the rectangular channel (block 306). The curb drain modular insert comprises a molded body that is formed to have a rear surface, bottom surface and lateral surfaces that are generally planar. The lateral surfaces are generally parallel to each other. Each lateral surface and rear surface and bottom surface are generally perpendicular to each other for being placed into the rectangular channel cut into the contoured curb. The curb drain modular insert further includes a contoured top surface of the molded body that conforms to portions of the contoured curb that are adjacent to the rectangular channel. The curb drain modular insert includes a horizontal bore that is formed in the molded body from the rear surface through the top surface to conduct ground water from the ground drain pipe.

It must be noted that, as used in this specification and the appended claims, the singular forms "a," "an" and "the" include plural referents unless the content clearly dictates otherwise. Thus, for example, reference to a "colorant agent" includes two or more such agents.

Unless defined otherwise, all technical and scientific terms used herein have the same meaning as commonly understood by one of ordinary skill in the art to which the invention pertains. Although a number of methods and materials similar or equivalent to those described herein can be used in the practice of the present invention, the preferred materials and methods are described herein.

As will be appreciated by one having ordinary skill in the art, the methods and compositions of the invention substantially reduce or eliminate the disadvantages and drawbacks associated with prior art methods and compositions.

It should be noted that, when employed in the present disclosure, the terms "comprises," "comprising," and other derivatives from the root term "comprise" are intended to be open-ended terms that specify the presence of any stated features, elements, integers, steps, or components, and are not intended to preclude the presence or addition of one or more other features, elements, integers, steps, components, or groups thereof.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

While it is apparent that the illustrative embodiments of the invention herein disclosed fulfill the objectives stated above, it will be appreciated that numerous modifications and other embodiments may be devised by one of ordinary skill in the art. Accordingly, it will be understood that the appended claims are intended to cover all such modifications and embodiments, which come within the spirit and scope of the present invention.

What is claimed is:

1. A curb drain modular insert comprising:

a molded body that is formed to have a rear surface, bottom surface and lateral surfaces that are generally planar, the lateral surfaces being generally parallel to each other; each lateral surface and rear surface and bottom surface being generally perpendicular to each other for being placed into a rectangular channel cut into a contoured curb, wherein the molded body is further formed to have a contoured top surface that conforms to portions of the contoured curb that are adjacent to the rectangular channel;

wherein each lateral surface comprises a recess to receive sealing material; and a horizontal bore that is formed in the molded body from the rear surface through the top surface to conduct ground water.

2. The curb drain modular insert of claim 1, wherein the horizontal bore has rectangular transverse cross section.

3. The curb drain modular insert of claim 1, wherein the horizontal bore has a circular transverse cross section.

4. The curb drain modular insert of claim 1, wherein the molded body comprises a polymer material.

5. The curb drain modular insert of claim 1, wherein the molded body comprises a concrete material.

* * * * *